United States Patent [19]

Martin

[11] 3,947,023

[45] Mar. 30, 1976

[54] EXERCISE BOARD

[76] Inventor: Francisco Hidalgo Martin, P.O. Box 1, Blythe, Calif. 92225

[22] Filed: Aug. 12, 1974

[21] Appl. No.: 496,844

[52] U.S. Cl. ..... 272/57 R
[51] Int. Cl.[2] ..... A63B 23/02
[58] Field of Search ..... 272/57 R, 58, 83 R

[56] References Cited

UNITED STATES PATENTS

| | | | |
|---|---|---|---|
| 695,538 | 3/1902 | Clairmont | 272/57 R |
| 1,721,709 | 7/1929 | Odell | 272/57 R |
| 3,226,115 | 12/1965 | Underhill | 272/58 |
| 3,295,847 | 1/1967 | Matt | 272/83 R |

*Primary Examiner*—Anton O. Oechsle
*Assistant Examiner*—Joseph R. Taylor

[57] ABSTRACT

A TORSO-CENTRIC EXERCISE BOARD consisting of a padded rectangular board with a padded headrest and a removable crossbar in two pieces, extending beyond the borders of the board, which crossbar is assembled by inserting one piece into a metal casing which encloses the other piece and bolting the assembled crossbar into a recessed cut in the board. In the extremeties of the crossbar on each side is a series of orifices, symmetrical and equidistant, for the adjustment of a pair of handgrips which consist of a post on a platen base, which base, when the posts or handgrips are adjusted in the orifices, supports the crossbar above the floor.

The board is provided with a handle for carrying and straps on the back for storage of the crossbars and the handgrips. The whole is of such mechanical simplicity as to avoid the problems of malfunction common in more complex mechanical devices and to make for greater economy of manufacture, without sacrificing any features necessary to its purpose which is to provide the gymnast with a necessary means of support while performing exercises which reduce the abdomen, waist and hips, strengthen the muscles of the back and abdomen and improve the circulation of blood and lymph through the body.

1 Claim, 10 Drawing Figures

EXERCISE BOARD

BACKGROUND OF THE INVENTION

The TORSO-CENTRIC EXERCISE BOARD was developed to eliminate all the fat that accumulates on the abdomen, waist and hips and at the same time give perfect circulation of the blood and lymph throughout the system because the exercises are done with the feet up and the head down.

In the TORSO-CENTRIC EXERCISE SYSTEM you only need to do four exercises. With these four exercises you are working constantly on the waist and abdomen without interruption and this the reason you destroy all the fat.

The board is made so simple but so clever that you can use it indoors in the living room or bedroom or outdoors in the yard or garden, or take it in your car to the beach or mountains. Doing these exercises five minutes a day will rejuvenate ones entire system. I believe that much poor posture, backache and fatigue are due to weakness of the muscles of the back, waist and abdomen which weakness proper use of the TORSO-CENTRIC EXERCISE BOARD will correct.

It took me twenty years to develop this invention. I have been a professional athlete for sixteen years and today, due to my invention and my TORSO-CENTRIC EXERCISE SYSTEM, I am in better shape than ever.

A. A rectangular board with a rectangular crossbar in two pieces to be assembled and bolted into a recessed cut below the headrest or disassembled and stored on the back of the board.

B. At the extremeties of the crossbar are orifices for the adjustment of the handgrips to suit the reach of the gymnast. The handgrips are in the form of a post on a platen base which supports the crossbar above the floor.

C. The board is designed for compact storage and easy portability. There is a carrying strap or handle on one side and straps on the back for the storage of the crossbars and handgrips.

D. The board has a headrest and both headrest and board are padded for the comfort of the gymnast. The present model is covered with plastic but any suitable material such as cloth or leather may be used.

FIGS. 7–10 shows how the TORSO-CENTRIC EXERCISE BOARD is to be used.

Figure 7:
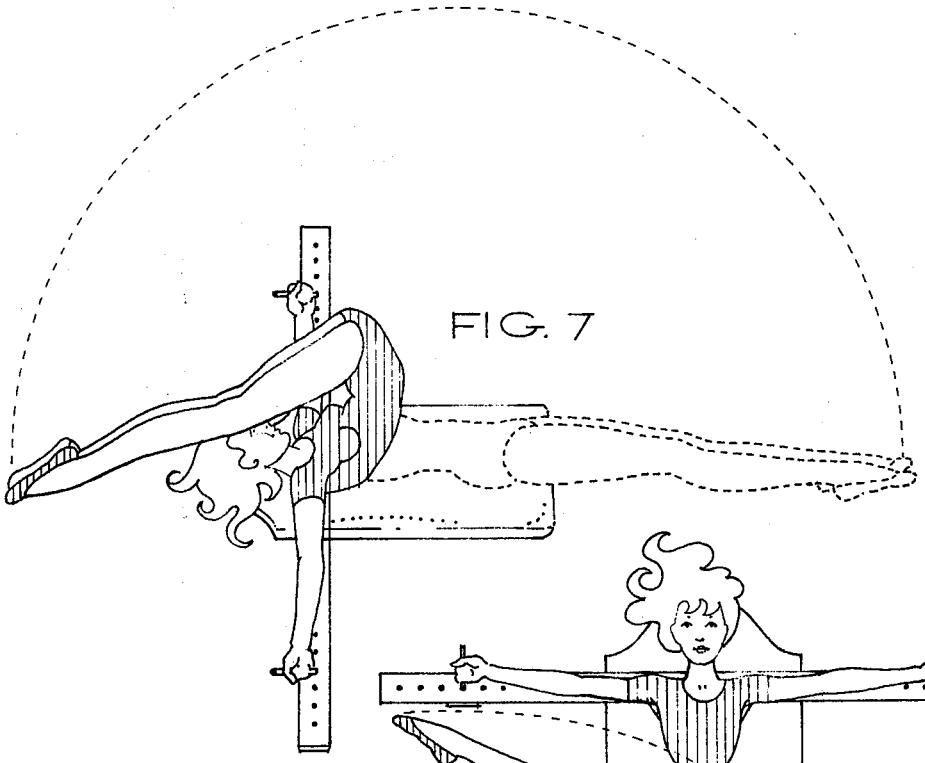

FIG. 7: the gymnast, lying on his back and gripping the handgrips which have been adjusted to his maximum reach, and keeping his knees straight, swings his legs over his head to touch the floor with his toes at least 10 times without pausing.

Figure 8:
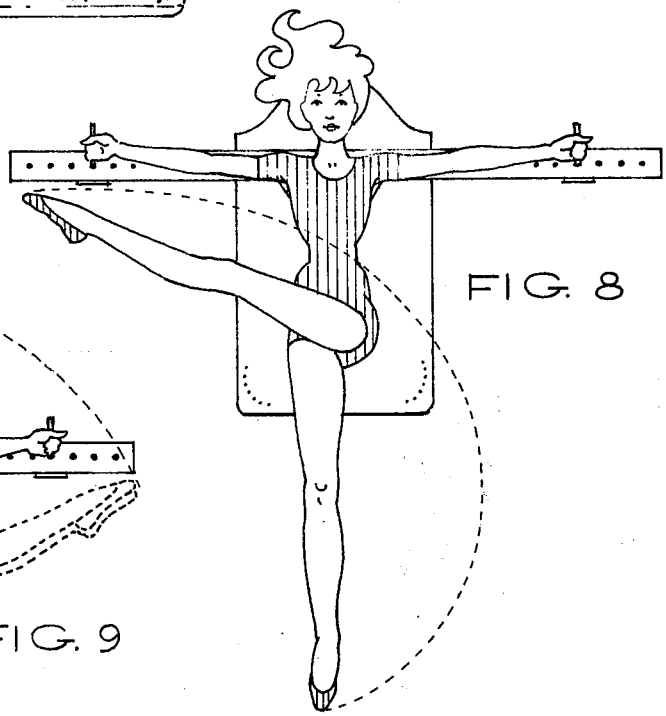

FIG. 8: the gymnast, lying on his back and gripping the handgrips which have been adjusted to his maximum reach, and keeping his knees straight, swings his right leg as far as he can toward his left hand, then returns to the original position and swings his left leg to the right the same. He does this at least 20 times, 10 on each side.

Figure 9:
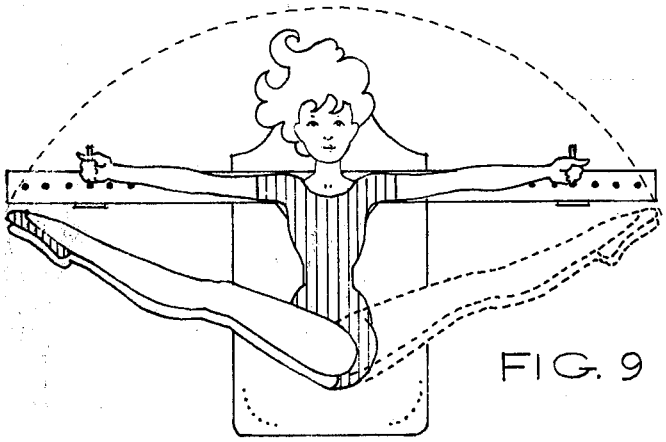

FIG. 9: the gymnast, lying on his back and gripping the handgrips which are adjusted to his maximum reach and keeping his knees straight, swings both legs as far as he can toward his right hand and then toward his left hand, back and forth, a total of 20 times, 10 on each side.

Figure 10:
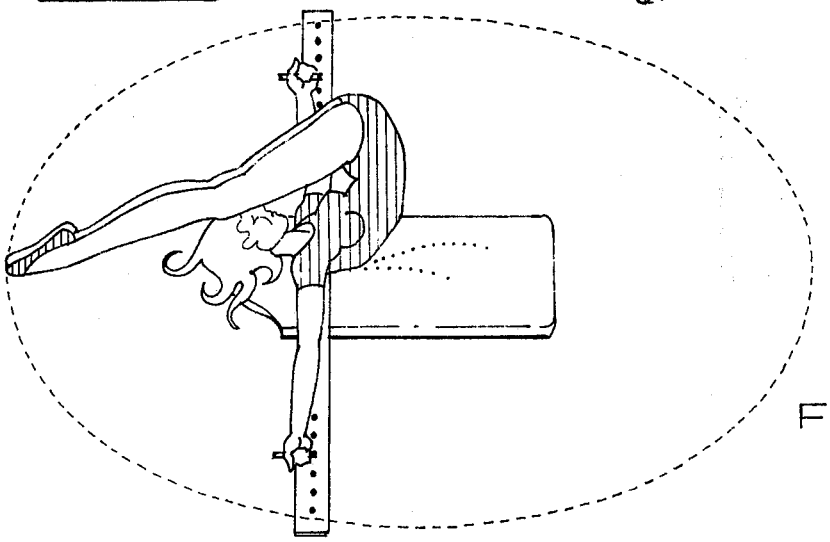

FIG. 10: the gymnast, lying on his back and gripping the handgrips which are adjusted to his maximum reach and keeping his knees straight, swings the lower half of his body in a circle, 10 times to the right and 10 times to the left. His feet describe a circle around his body. This is a difficult exercise and it is sometimes impossible to perform it well at the start until sufficient strength has been built up.

Figure 1:
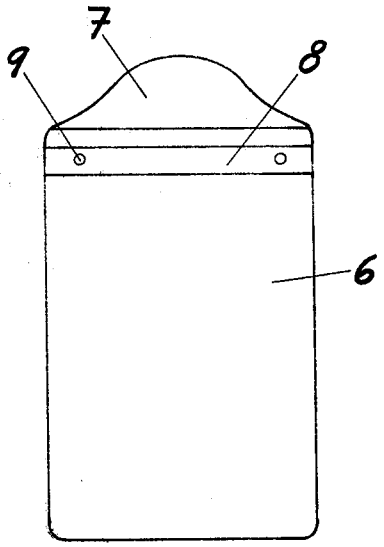
Figure 2:
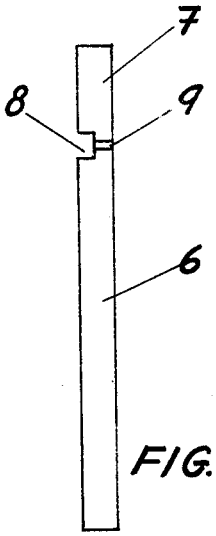

FIGS. 1–5 show the mechanical details of the TORSO-CENTRIC EXERCISE BOARD which are as follows:

FIGS. 1 and 2 represent the plane and side view of the TORSO-CENTRIC EXERCISE BOARD.

Figure 3:
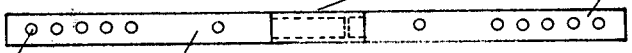

FIG. 3 is a detail drawing of the crossbar showing the metal which encases the center of the crossbar. The crossbar is actually in two parts and the metal casing is attached to one of the two parts so that when the crossbar is assembled, the second bar is inserted into the metal casing to form the complete crossbar.

Figure 4:
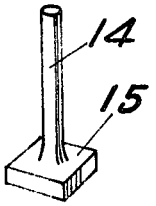

FIG. 4 shows one of the two posts with its platen base.

Figure 5:
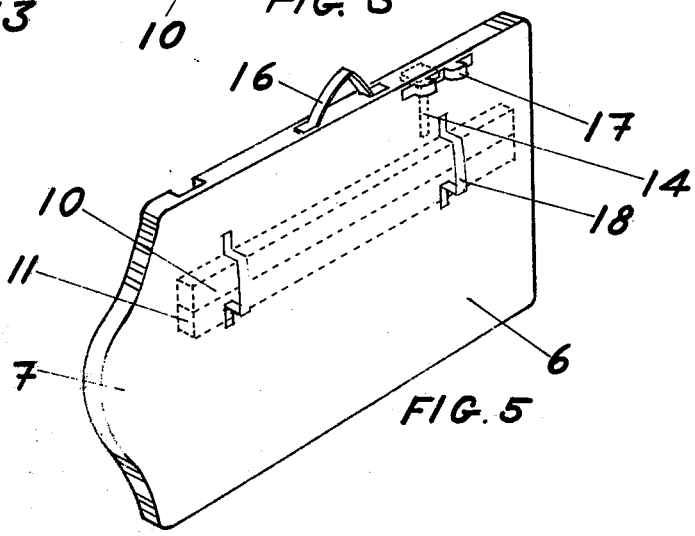
Figure 6:
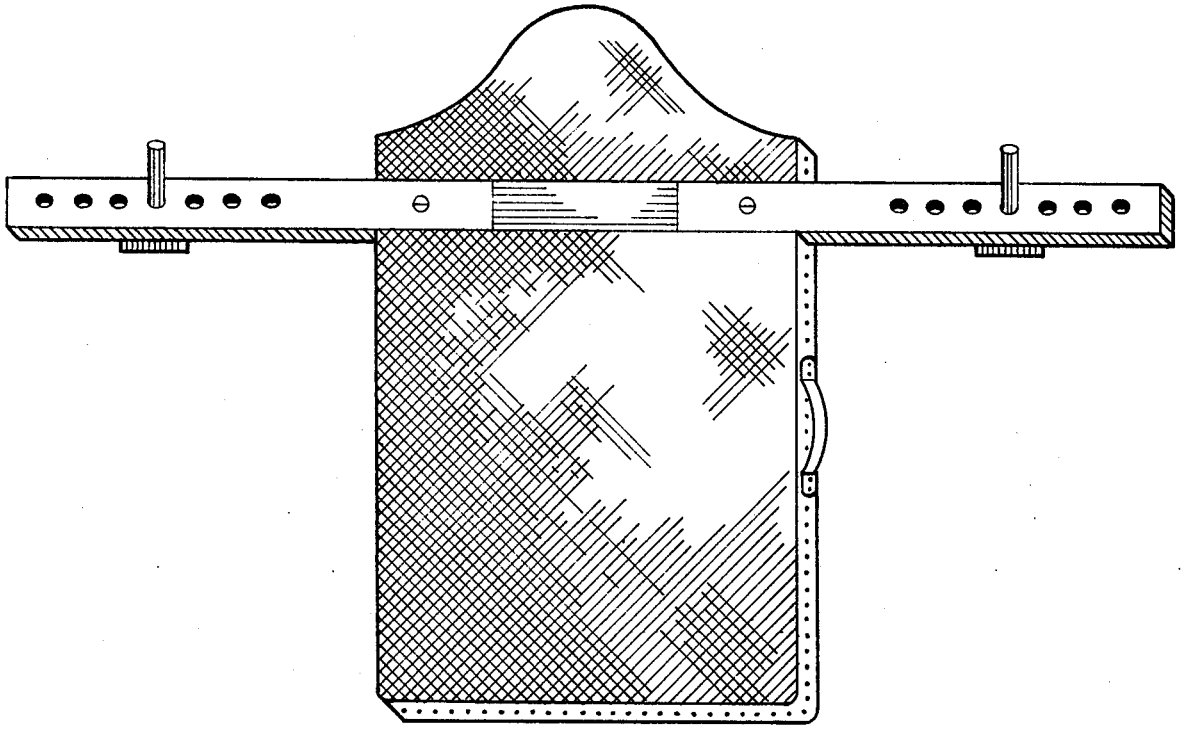
FIG. 6 shows the TORSO-CENTRIC EXERCISE BOARD assembled and ready to use. Its characteristics are as follows.

FIG. 5 is a perspective drawing of the back of the board showing the straps arranged for storage of the crossbars and posts.

Examining the details of the drawing, we find:

--6--the board is softly padded for the comfort of the gymnast who will rest his back upon it.

--7--the board is finished with a headrest of equal thickness also padded.

--8--between the headrest and the body of the board there is a transverse cut into which are bolted the crossbars.

--9--two holes placed symmetrically for the bolts which hold the crossbars to the board.

The crossbars 10 and 11 are joined together by a metal inlay 12. This metal inlay encases one bar and the second bar is thrust into the casing to form the complete crossbar. The assembled crossbar is then fitted into the transverse cut 8 and joined to the board by bolts fitted into the orifices 9.

In the extremeties of the crossbar 10 and 11 are a series of holes or orifices 13, symmetrical and equidistant through which will be placed, one on each side, two cylindrical metal posts which have a platen base 15 which support the crossbar above the floor. These posts, or handgrips, will be so adjusted in the crossbars as to force the gymnast to stretch his arms while gripping the posts to perform the exercises.

The board has on one of its borders, handles 16 to grasp while carrying it; also two leather straps 17 for the storage of the posts 14. On its back the board has two straps 18 for the storage of the two crossbars 10 and 11.

The purpose of the TORSO-CENTRIC EXERCISE BOARD is to provide the gymnast with the support and balance which are necessary for the practice of the TORSO-CENTRIC EXERCISES which strengthen the muscles of the back and abdomen, the pectorals and upper arms, and slim the waist, abdomen and hips. The board is designed to be quickly dismantled for compact storage and to be easily carried to any location the gymnast chooses to work.

In production it will be possible to vary the form, dimensions, proportions and disposition of the different elements and the materials utilized without modifying the original purpose of the TORSO-CENTRIC EXER- CISE BOARD which is to brace, support, aid and sustain the gymnast in his practice of the TORSO-CENTRIC EXERCISES.

What I claim as my invention and desire to secure by Letters of Patent is:

1. An exercising apparatus for use in developing the muscles of a user's arms and torso comprising in combination: a generally rectangular board having a planar bottom surface for contact with the floor, an opposite planar top surface for supporting the torso of a user when reclining thereon; a detachable crossbar of uniform cross-section, said crossbar including a central casing and a pair of end sections each having a first extremity containing a plurality of like longitudinally spaced orifices and a second extremity removably insetable in said central casing; a transverse recess in said top surface of said board intersecting opposite side edges thereof for receiving said crossbar, said recess being of sufficient depth to retain said crossbar in or below the plane of said top surface and; a plurality of hand grip members each comprising a platen base having a cylindrical stake projecting outwardly therefrom, said stake being insertable through any of said spaced orifices in said crossbar from the lower side thereof to project upwardly from the opposite side to provide a handgrip thereon at the location of said orifice, said platen bases having a thickness substantially equal to the height of the lower surface of said crossbar above the plane containing the bottom surface of said board when said crossbar is retained in said transverse recess, whereby said platen base functions to support the extremity of said crossbar above the floor when said cylindrical stake is inserted through any of said orifices to serve as a handgrip.

* * * * *